US005203101A

United States Patent [19]

Bryan

[11] Patent Number: 5,203,101

[45] **Date of Patent: * Apr. 20, 1993**

[54] DIGGING CHAIN VIBRATORY SYSTEM

[76] Inventor: John F. Bryan, 4250 W. Lovers La., Dallas, Tex. 75209

[ * ] Notice: The portion of the term of this patent subsequent to Oct. 15, 2008 has been disclaimed.

[21] Appl. No.: 729,945

[22] Filed: Jul. 15, 1991

Related U.S. Application Data

[63] Continuation-in-part of Ser. No. 444,402, Dec. 1, 1989, Pat. No. 5,056,244.

[51] Int. Cl.[5] ..... E02F 5/08

[52] U.S. Cl. ..... 37/189; 37/94; 37/DIG. 18; 74/61; 74/87; 267/136; 267/220; 299/69

[58] Field of Search ..... 405/182; 74/61, 87; 37/DIG. 18, 94, 95, 96, 97, 189, 190; 267/220, 153, 136, 141, 140; 299/69

[56] References Cited

U.S. PATENT DOCUMENTS

| | | | |
|---|---|---|---|
| 3,618,237 | 11/1971 | Davis | 405/182 X |
| 3,752,462 | 8/1973 | Wight | 267/140 |
| 3,935,712 | 2/1976 | Erickson et al. | 405/182 |
| 4,119,157 | 10/1978 | Shuck et al. | 405/182 X |
| 4,755,001 | 7/1988 | Gilbert | 37/190 X |
| 5,056,244 | 10/1991 | Bryan | 405/182 X |

FOREIGN PATENT DOCUMENTS

| | | | |
|---|---|---|---|
| 386087 | 9/1973 | U.S.S.R. | 37/94 |
| 458640 | 3/1975 | U.S.S.R. | 37/DIG. 18 |
| 522310 | 9/1976 | U.S.S.R. | 37/DIG. 18 |
| 618490 | 8/1978 | U.S.S.R. | 37/DIG. 18 |
| 653352 | 3/1979 | U.S.S.R. | 37/94 |
| 659691 | 5/1979 | U.S.S.R. | 37/DIG. 18 |
| 874907 | 10/1981 | U.S.S.R. | 37/DIG. 18 |

*Primary Examiner*—Randolph A. Reese
*Assistant Examiner*—Arlen L. Olsen
*Attorney, Agent, or Firm*—John F. Bryan, Jr.

[57] ABSTRACT

The digging apparatus support boom of a continuous excavating machine is vibrated in a directional mode so as to enhance digging efficiency. Directionally compliant mounting of the boom isolates this vibration from the machine proper while allowing unimpaired application of digging torque and crowd forces.

22 Claims, 9 Drawing Sheets

DIGGING CHAIN VIBRATORY SYSTEM

Continuation-in-part of Ser. No. 07/444,402, filed Dec. 1, 1989, now U.S. Pat. No. 5,056,244.

TECHNICAL FIELD

This invention relates to continuous digging chain or rock saw type excavating machines which use formation penetrating bit attachments, wherein vibration of said bit attachments is known to enhance productivity, and more particularly, to method and apparatus for vibrating the entire digging boom assembly in an angular mode about the suspension point thereof. The exciting force is applied at the center of percussion of the boom assembly which is suspended on directionally compliant mounts so as to support the digging forces while isolating the main frame from this vibration.

BACKGROUND AND SUMMARY OF THE INVENTION

A category of machines utilizing a continuous chain digging element is widely used in the earthmoving arts. These so called chain saw excavating machines range from about ten horsepower to several hundred horsepower and are generally used in trenching applications for laying pipe or cable. These machines, examples of which are manufactured by TESMEC USA, Inc., of Mansfield, Tex., and Vermeer Manufacturing Company of Pella, Iowa, are mounted on crawler track undercarriages for purposes of both stability and flotation, however pneumatic tires may also be used.

TESMEC trencher models TRS 900 and TRS 1000 have optional, interchangeable booms so that either a chain saw or a circular rock saw may be used as the digging element, depending upon the application. Rock saws are considered to be better adapted to digging rock and hard formations and are used for narrow cable laying trenches, while chain saws are normally used for the wider, deeper trenches needed for laying pipe.

These machines are generally more productive when working in the softer formations. Excavation of the harder formations is more difficult and costly in terms of time, power consumption and attrition. Very hard, specialized cutting teeth, such as Part Number CCT-735-HBR, made by the Carboloy Construction Products of Bristol, Va., have been developed which improve productivity in these hard materials, within limits.

To those skilled in the art it is known that tooth vibration offers great potential for increased productivity as well as the capability of working in harder materials. Various studies that compare the efficacy of digging teeth, with and without vibration, have shown that dramatic production increases can be achieved with a vibratory system. Efforts to devise practical means for realizing such benefits with a vibrating chain saw have been thwarted by unacceptably rapid chain wear and the deleterious effects of the vibration to the supporting structure.

An object of the present invention is then, to provide a practical means for vibrating the cutting teeth while minimizing the factors which induce chain wear.

Isolation of this vibration so that it is confined to to the chain saw boom assembly is essential to any practical design. Without such isolation, the vibratory forces are as destructive to the machine itself as to the formation it is excavating. A second object of the present invention is therefore, to provide suitable vibration isolating support means for the vibrating chain saw boom assembly. This support means must not only carry the high crowd and chain pull forces involved in the penetration of hard formations, but must also yield and allow the displacements of vibration so as to isolate the excavator main frame from the effects thereof.

Because of the shock and vibration forces attendant to cutting rock, normal operating conditions are such that chain saw excavators, without the invention, require an unusual degree of maintenance. Another object of the invention therefore, is to moderate these forces and reduce their effects on the excavator main frame and other components.

FIG, 9 shows a detail view of a cutting tooth in contact with the work face.

Figure 10:
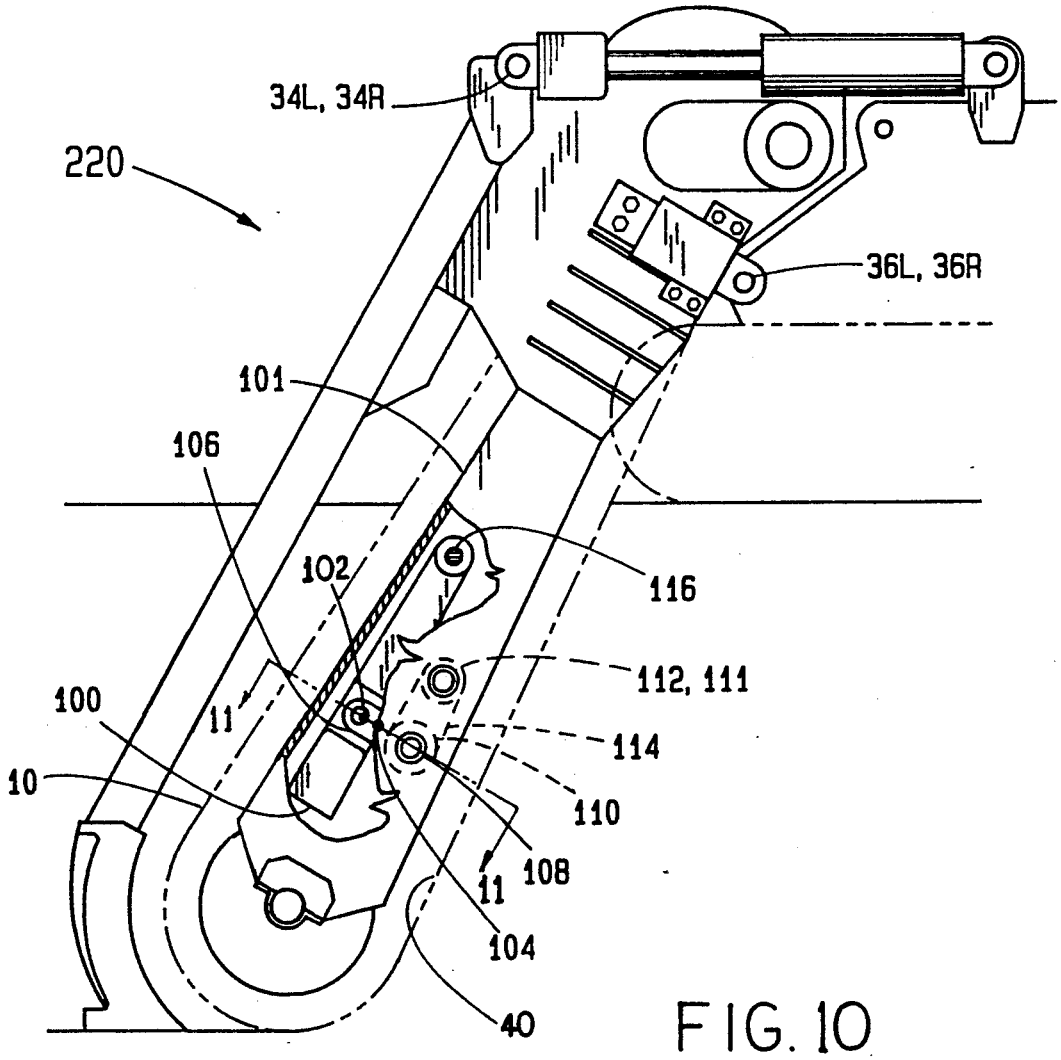

FIG. 10 shows a detailed side view of an oscillatory means for chain boom assembly vibration.

Figure 11:
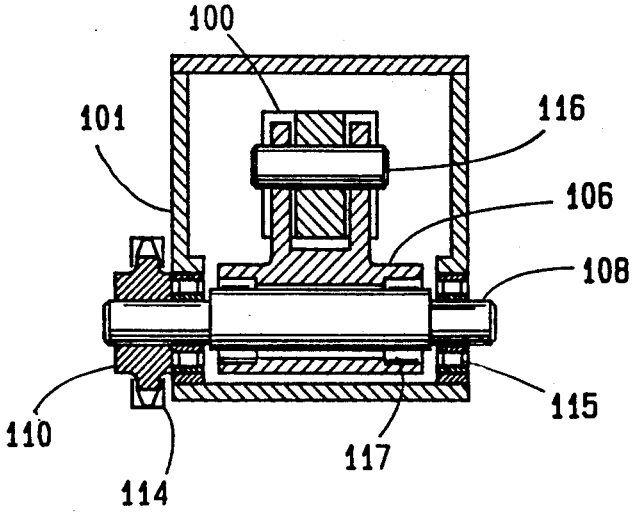

FIG. 11 shows a section view of the oscillatory means of FIG. 10 taken along line 11—11.

Figure 12:
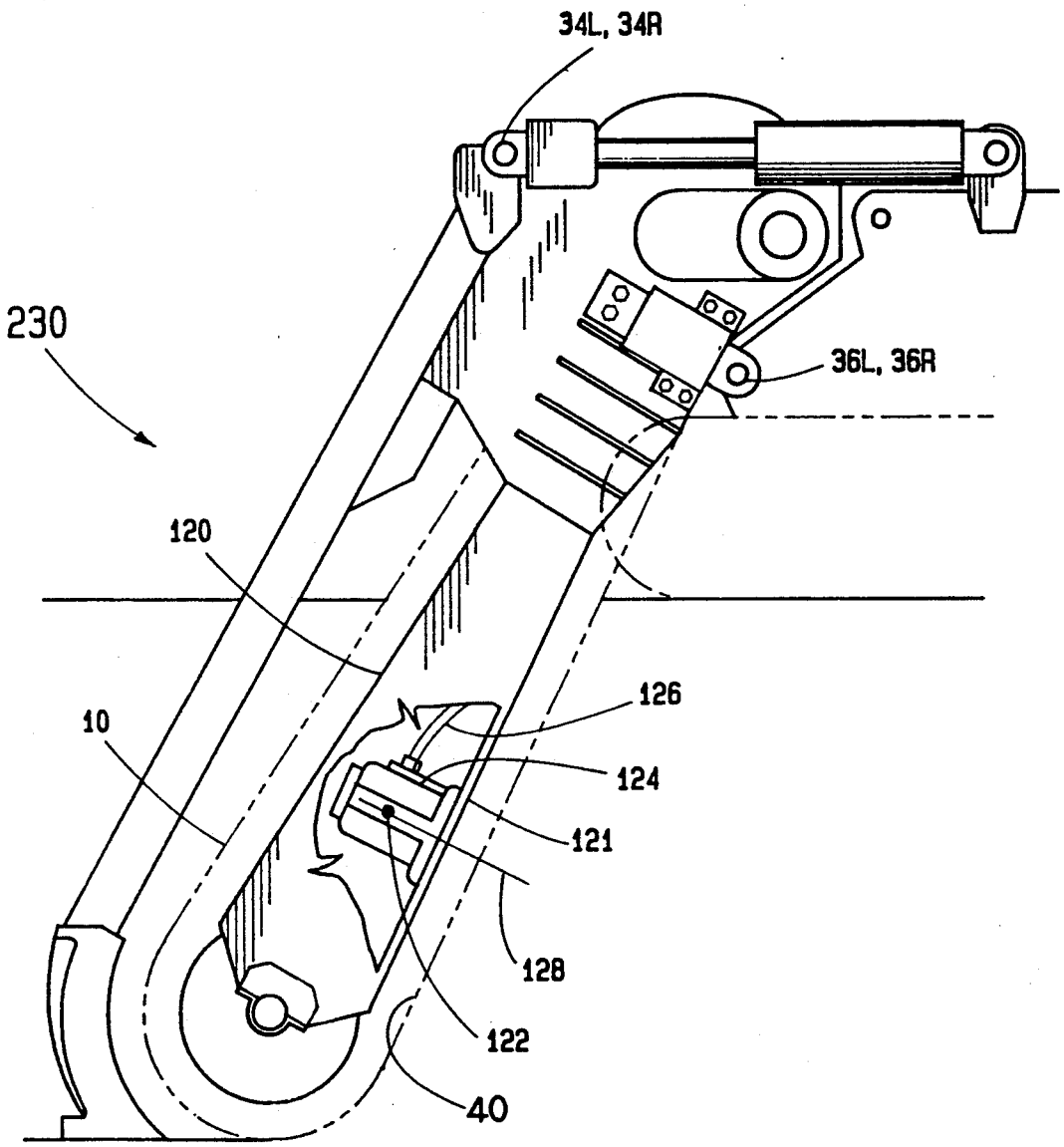

FIG. 12 shows a detail side view of a reciprocating means for chain boom assembly vibration.

Figure 13:
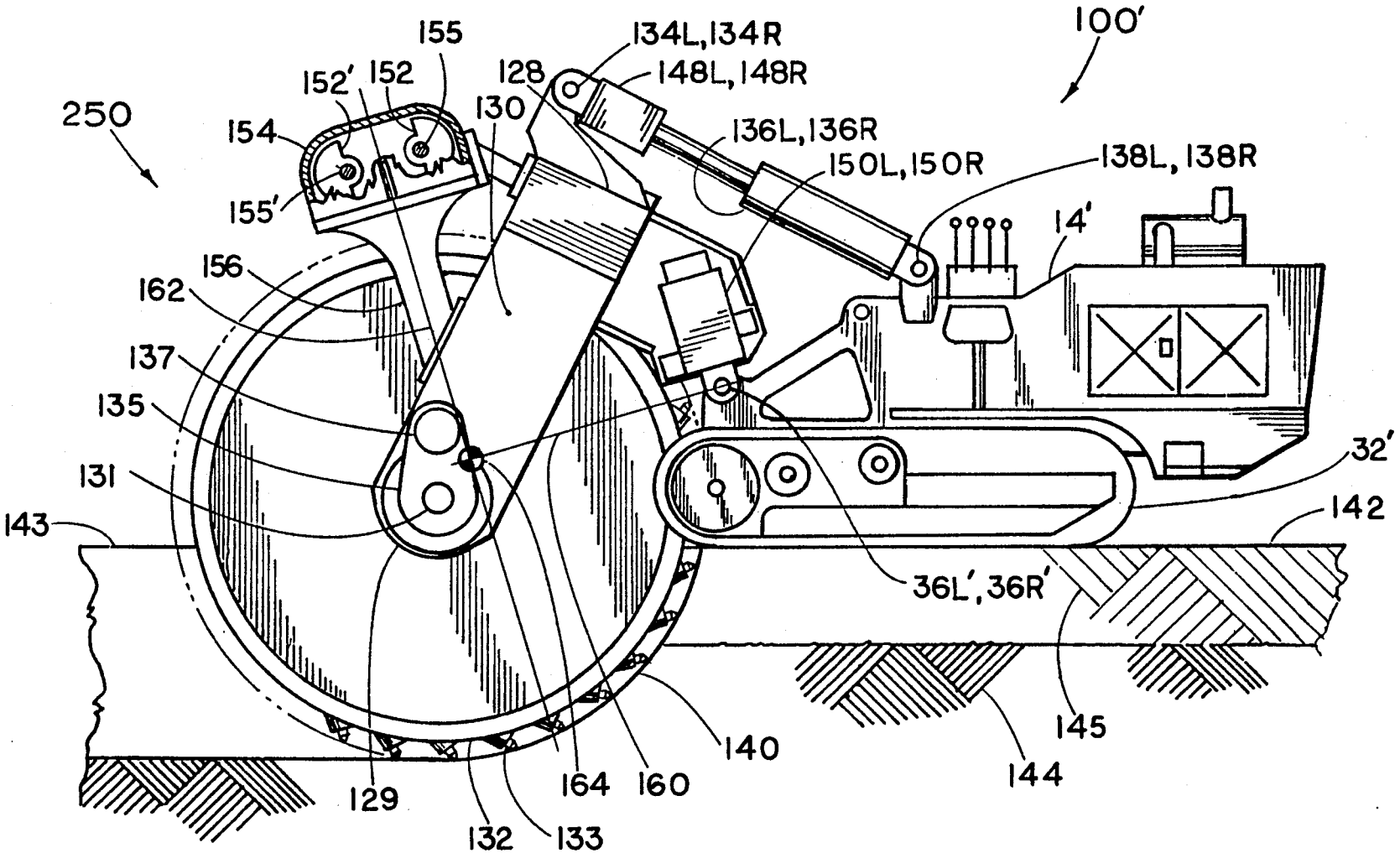

FIG. 13 shows a side view of the invention as applied to a typical rock saw excavator.

Figure 14:
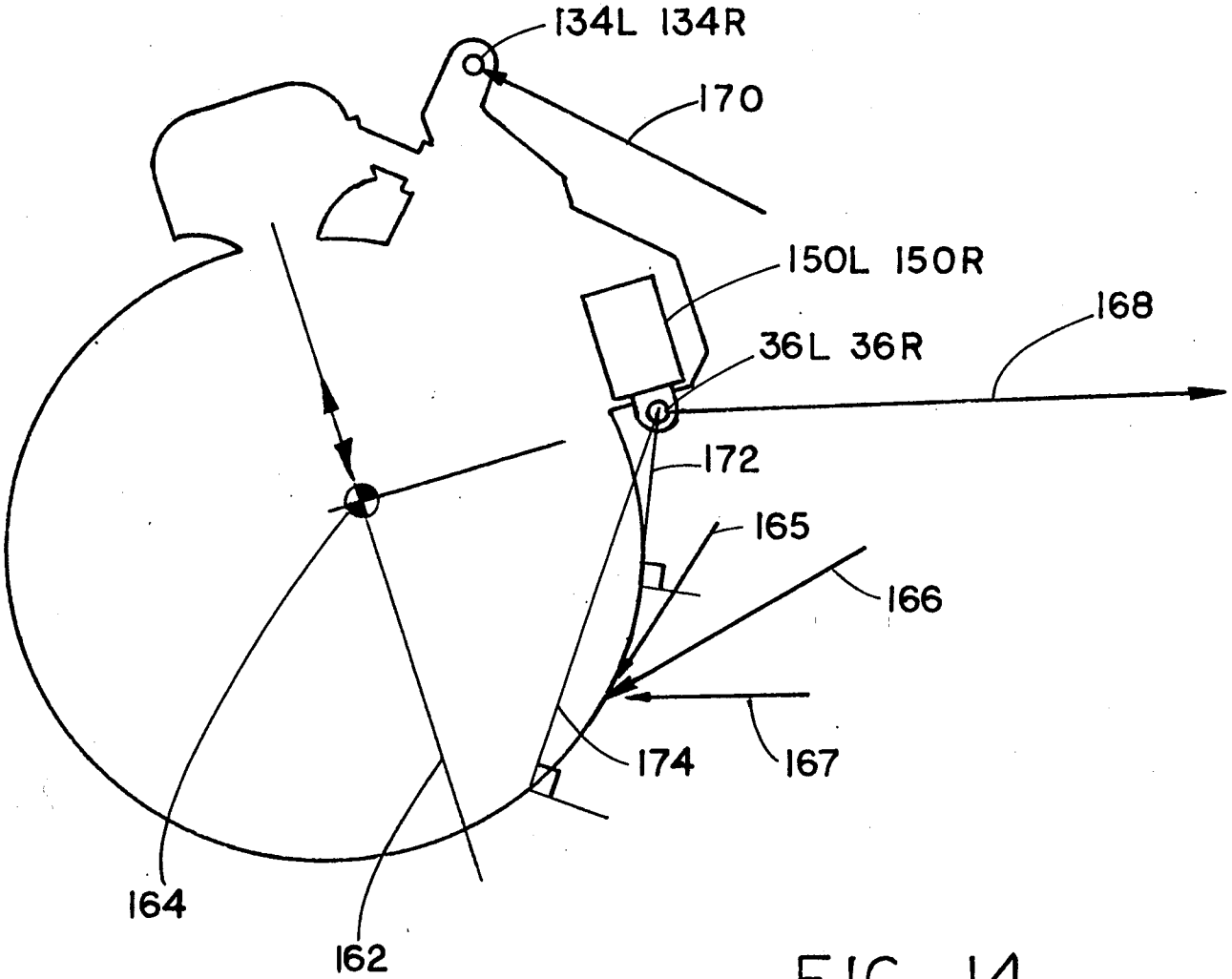

FIG. 14 shows a free body force diagram of the excavator of FIG. 13.

DETAILED DESCRIPTION

Figure 1:
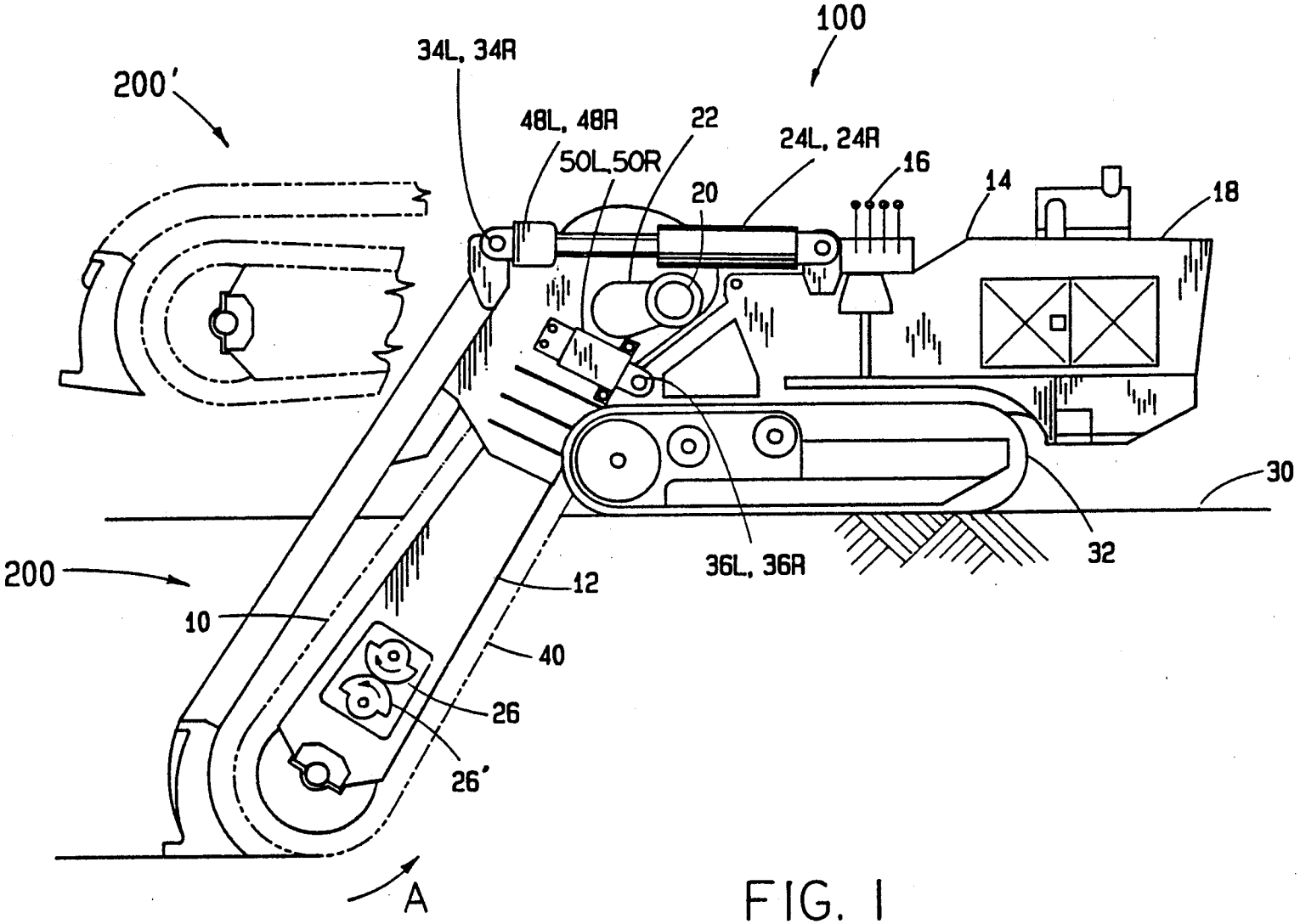
FIG. 1 shows a side view of the invention as applied to a typical chain saw excavator.
Figure 3:
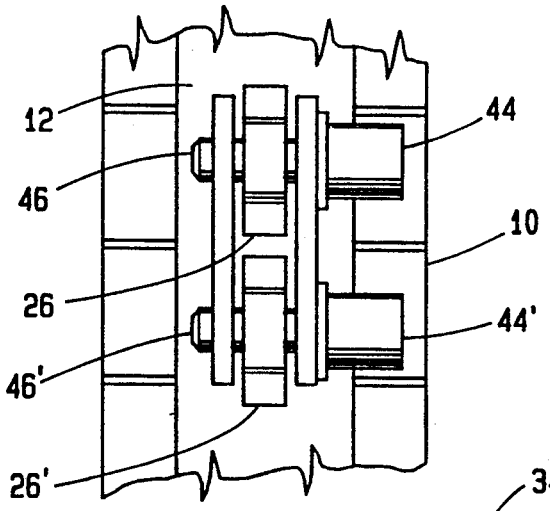
FIG. 3 shows a section view taken along the line 3—3 of FIG. 2.

Referring first to FIG. 1, herein is shown a typical chain saw type excavating machine 100 using a preferred embodiment of the present invention. The chain saw boom assembly 200 comprises a digging chain 10 mounted on a digging chain support boom 12 which is pivotally attached to excavator main frame 14. The chain saw boom assembly 200' shows the raised, non-working position of chain saw boom assembly 200. The operator controls 16 and the power supply 18 are mounted on the excavator main frame 14, while digging chain drive motors 20 and gear boxes 22 are mounted on either side of digging chain support boom boom 12. The working depth of the digging chain 10 is controlled by varying the length of hydraulic cylinders 24L and 24R. The excavator main frame 14 is supported for movement along the ground surface 30 by undercarriage 32 so that the digging chain 10 is crowded forward against the cutting surface 40. The digging chain 10 rotates in the direction of Arrow A so that material is broken from the cutting surface 40 and carried up to the ground surface 30.

In the preferred embodiment of the invention, balanced, counter-rotating eccentric weights 26 and 26' are mounted to the digging chain support boom 12, acting at the center of percussion 42 of boom assembly 200 relative to pivotal connections 36L and 36R. The balanced eccentric weights 26 and 26' rotate on parallel horizontal axes substantially equidistant from, and parallel to the plane of cutting surface 40. The rotation is synchronized, and the phase angles are timed so that opposed centrifugal forces of rotation cancel out, producing a straight line vibration on an axis substantially perpendicular to the plane of cutting surface 40.

The balanced eccentric weights 26 and 26' and driven to rotate by two similar hydraulic motors 44 and 44', which are mutually connected to a hydraulic supply circuit. It has been found that rotating eccentric weights so driven will seek synchronous speeds and phase angles when fixedly mounted to a pivotal chain saw boom assembly. An alternate means for driving the counter-rotation of balanced eccentric weights 26 and 26' is by using only hydraulic motor 44, and driving shaft end 46' from shaft end 46 with a one-to-one ratio gear set.

Locating the balanced rotating eccentric weights 26 and 26' at or near to the center of percussion 42 of chain saw boom assembly 200 causes the entire chain saw assembly 200 to vibrate in an angular mode about connections 36L and 36R, while minimizing the resulting reaction forces. The hydraulic cylinders 24L and 24R, terminate in cylinder isolation connectors 48L and 48R to make pivotal connections to the excavator main frame 14 at 38L and 38R. The digging chain support boom 12 is joined to the pivotal connections 36L and 36R by excavator main frame isolation connectors 50L and 50R which assume a nominal deflection under the basic crowd and chain load working conditions.

The hydraulic cylinders 24L and 24R, in assembly with isolation connectors 48L and 48R, are "two point members", and thus are subjected only to axial loading. These components also deflect under crowd forces, both by compression of the hydraulic fluid in cylinders 24L and 24R and by deformation of isolation connectors 48L and 48R. This deflection is beneficial in that it protects the main frame 14 from fatigue stresses and damage by shock overloads. Isolation connectors 48L and 48R can relieve hydraulic cylinders 24L and 24R of the burden of this function through appropriate sizing. The excavator main frame isolation connectors 50L and 50R are placed perpendicular to, and in line with, the plane of the cutting surface 40, thus the crowd and vibration forces are carried axially by isolation connectors 50L and 50R while chain pull forces are carried perpendicular to the axis thereof.

Figure 6:
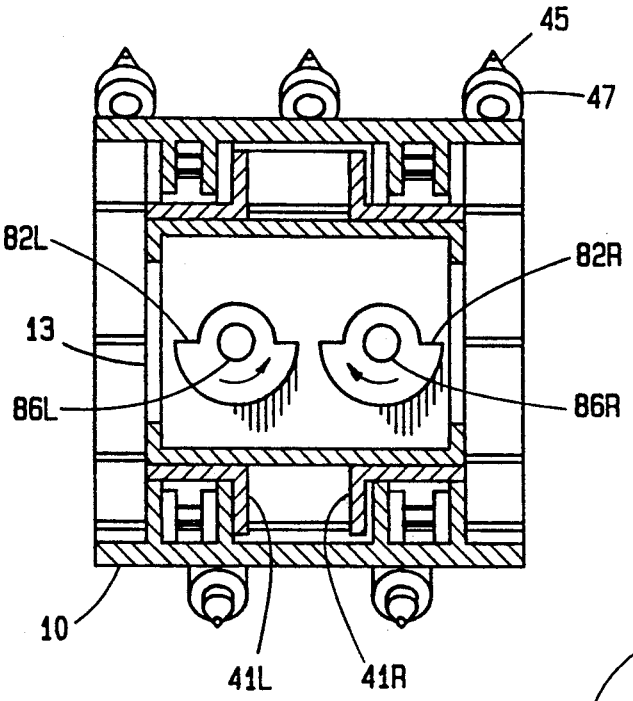
FIG. 6 shows a section view taken along line 6—6 in FIG. 5.
Figure 5:
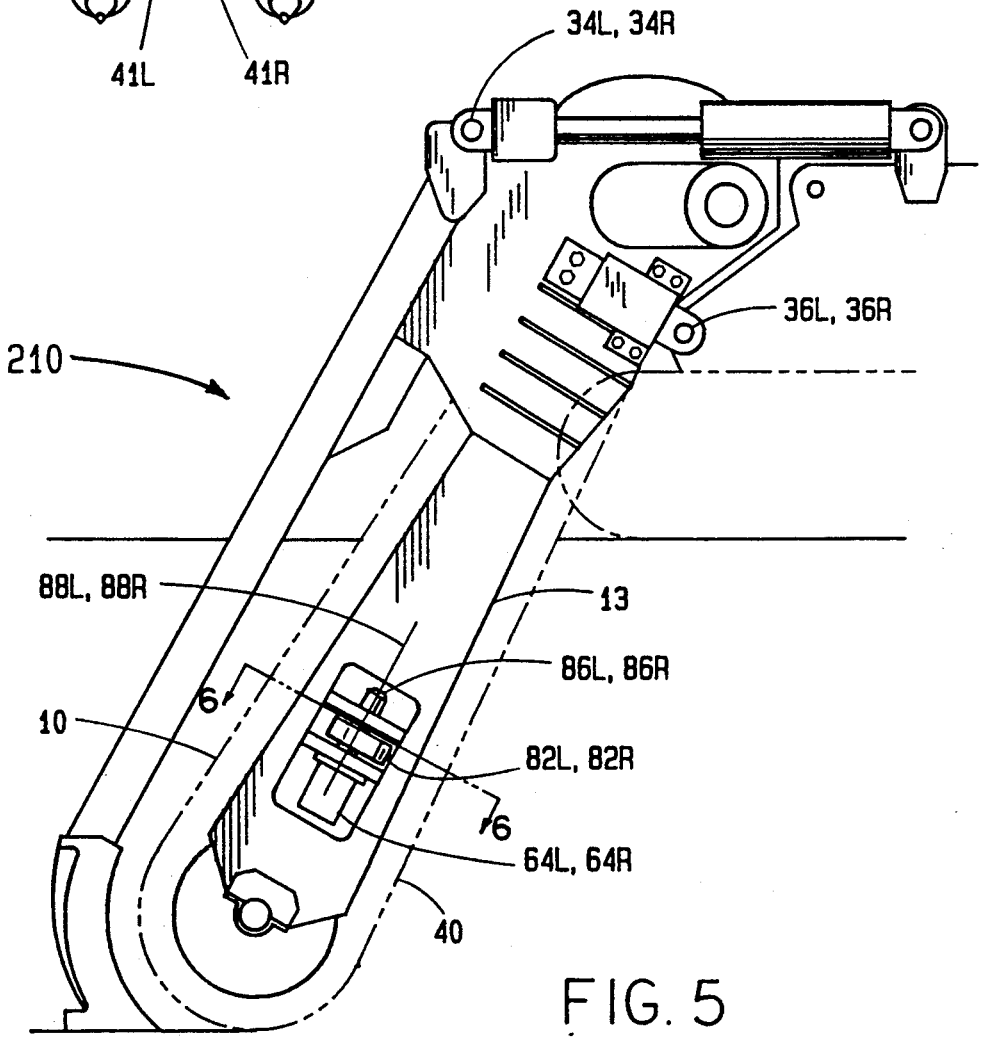
FIG. 5 shows a detailed side view of a second preferred embodiment of the invention.

An alternate embodiment of the invention is mounted in the digging chain support boom 13 of chain saw boom assembly 210, as shown in FIGS. 5 and 6, where balanced eccentric weights 82L and 82R are shown to be counter-rotating on parallel axes 88L and 88R which lie substantially equidistant from, and parallel to the plane of cutting surface 40 and extend in a vertical direction toward the main frame pivotal connections 36L and 36R. The rotation of eccentric weights 82L and 82R is synchronized, and the phase angles are timed so that opposed centrifugal forces of rotation cancel out, producing a straight line vibration perpendicular to the plane of cutting surface 40.

The balanced eccentric weights 82L and 82R are driven to rotate by two similar hydraulic motors 64L an 64R, which are mutually connected to a hydraulic supply circuit. It has been found that rotating eccentric weights so driven will seek synchronous speeds and phase angles when fixedly mounted to a pivotal chain saw boom assembly. An alternate means for driving the counter-rotation of balanced eccentric weights 82L and 82R is by a single hydraulic motor 44, and driving shaft end 86L together with shaft end 86R using a one-to-one ratio gear set.

In FIG. 6 are shown chain back supports 41R and 41L which serve to support the digging chain 10 for engagement with cutting surface 40.

Figure 7:
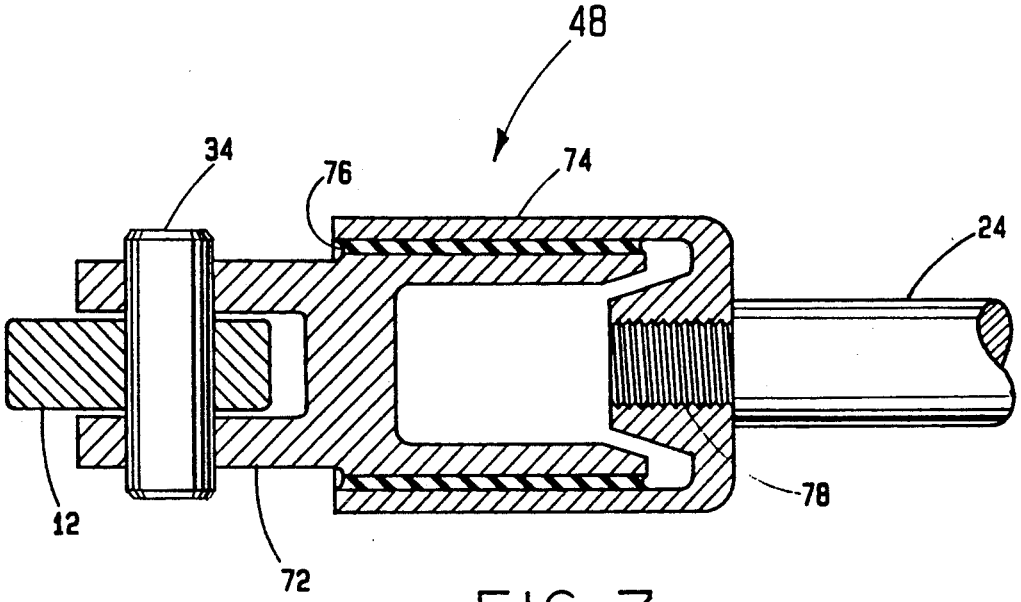
FIG. 7 shows a section view of a cylinder isolation mount taken along line 7—7 in FIG. 2.
Figure 8:
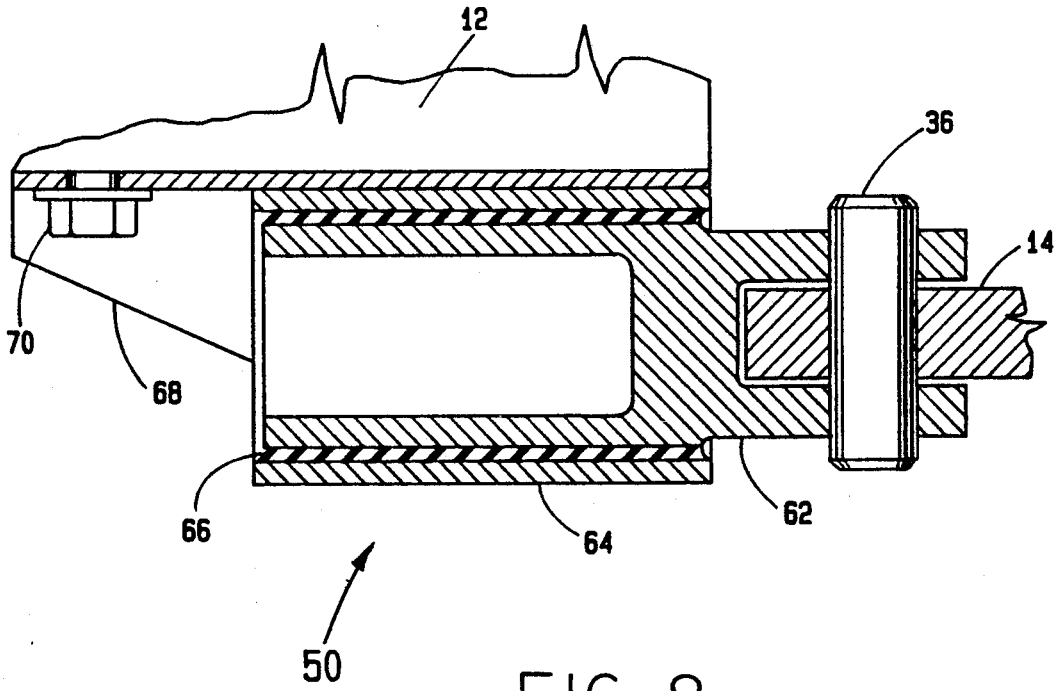
FIG. 8 shows a section view of the primary suspension element taken along line 8—8 in FIG. 2.

The isolation connectors 48 and 50 are shown in detail in FIGS. 7 and 8. The inner member 72 of cylinder isolation connector 48 is connected to digging chain support boom 12 by pivotal connection 34 while outer member 74 is connected to hydraulic cylinder 24 by threaded connection 78. The outer surface of inner member 72 is joined to the inner surface of outer member 74 by a continuous resilient layer 76 of substantially uniform thickness. The forces transmitted by this cylinder isolation connector 48 are, as previously discussed, purely axial in nature and are thus carried by the resilient layer 76 in shear. The material of choice for resilient layer 76 is an elastomer, since such materials are inherently stiff in compression and soft in shear. This allows these axial forces to be cushioned by relatively generous deflection.

The inner member 62 of excavator frame isolation connector 50 is connected to the excavator main frame 14 by pivotal connection 36 while the outer member 64 is welded to mount 68 which in turn is fixed to digging chain support boom 12 by bolts 70. The outer surface of inner member 62 is joined to the inner surface of outer member 64 by a continuous resilient layer 66 of substantially uniform thickness, preferably made of the same elastomeric material as resilient layer 76. As a result of the previously discussed orientation, crowd and vibration forces are carried by resilient layer 66 in shear, and chain pull forces are carried in compression. Consequently, crowd and vibration forces are cushioned while the chain pull forces are carried with very little deflection.

Normal operating conditions for chain saw excavators without the invention are generally considered abusive. Not only does the cutting of rock set up random vibration forces, but large chunks of rock are subject to breaking free and wedging between the chain 10 and the work face 40 causing heavy shock loads. The straight line vibration produced by counter-rotation of balanced eccentric weights 26 and 26' disrupts such wedging action. The vibration isolating connectors 48 and 50 also serve to moderate the random vibration forces, thus protecting the excavator main frame 14 and components mounted thereon. Surprisingly, the application becomes less abusive when accompanied by isolated vibration.

The cutting speed of digging chain 10 can be reduced when vibration is applied, while still improving production, because of the larger average chip size. Since cutting speed is an exponential factor contributing to the wear of digging chain 10, any speed reduction will be rewarded with longer service life. Straight line vibration perpendicular to the line of travel will not wear digging chain 10 as would multi-directional vibration and thus is the vibratory mode of choice.

Figure 2:
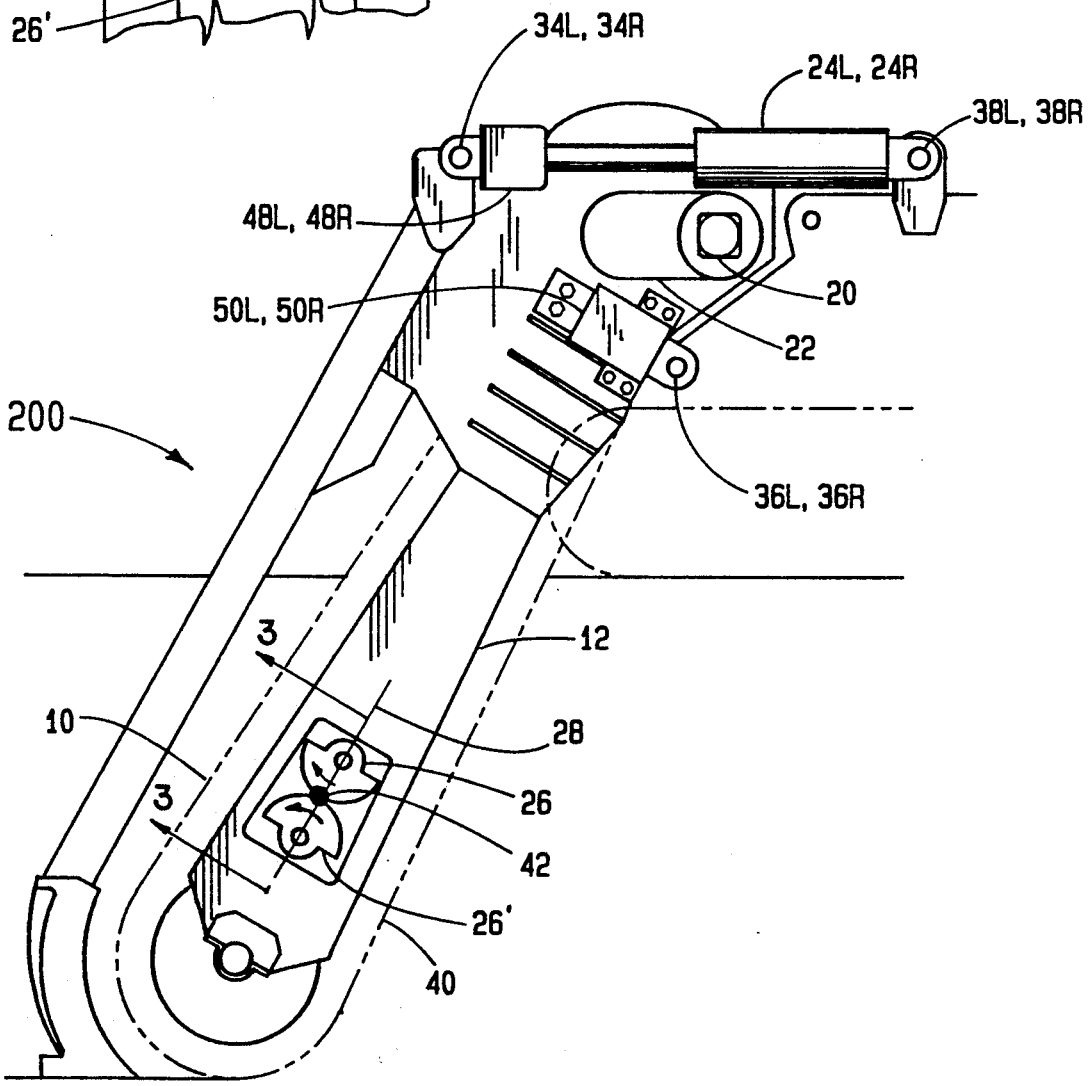
FIG. 2 shows a detailed side view of the preferred embodiment of the invention shown in FIG. 1.
Figure 4:
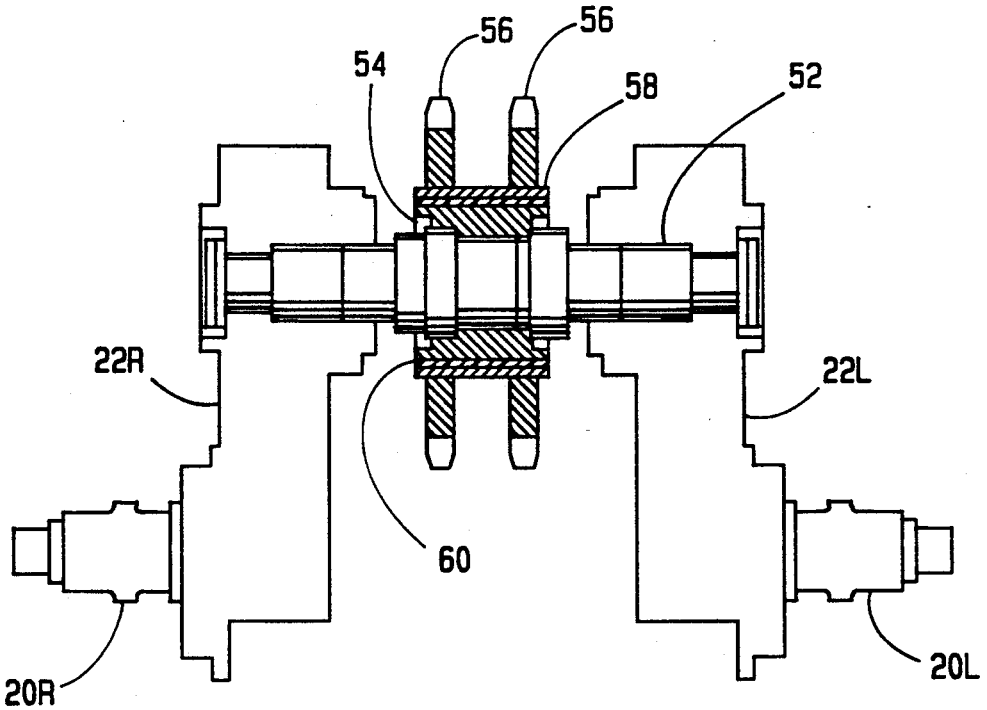
FIG. 4 shows a section view of the digging chain drive.

Referring now to FIG. 4, which is taken along section line 4—4 of FIG. 2, there is shown a detailed cross section of the drive means for digging chain 10. Hydraulic motors 20R and 20L drive through gear reducers 22R and 22L to rotate the drive shaft 52 which powers the rotation of the digging chain drive sprockets 56.

The sprocket outer hub 58 is joined to the sprocket inner hub 54 by resilient coupling 60. In this embodiment, the diameter and length of coupling 60 determine the level of shear stress in the elastomeric material of coupling 60 as it carries the torque required to drive digging chain 10. The angular deflection of sprocket outer hub 58 relative to sprocket inner hub 54 is determined by the radial thickness of resilient coupling 60. As the radial section thickness of resilient coupling 60 is reduced, said angular deflection decreases in a direct relationship. When working, the average pull of digging chain 10 establishes a basic dynamic angular deflection of resilient coupling 60 which varies with transient load variations induced by either the straight line vibration or by random shock conditions. A coupling at the input end of drive shaft 52 could also be designed to achieve the same working characteristics.

If a digging chain 10 cutting speed of 300 feet/minute and a vibration frequency of 2,400 cycles/minute are assumed, it can be readily shown that each tooth 45 impacts the work face 40 every 1.5" of digging chain 10 travel. The amplitude of vibration of the chain saw 200 is determined by its total mass-moment as related to the exciting straight line vibratory force and frequency. It is clear that the greater the amplitude of the chain saw 200, the larger the chip cut from the work face 40, but the more important factor is the peak cutting force per tooth 45 as calculated by the sum of the crowd force applied by undercarriage 30, plus the straight line vibratory force, divided by the number of teeth 45 engaged with cutting surface 40. The average tooth force required varies with the hardness of the formation, ranging from 800 lbs to 4,000 lbs for materials that are considered economically workable.

Figure 9:
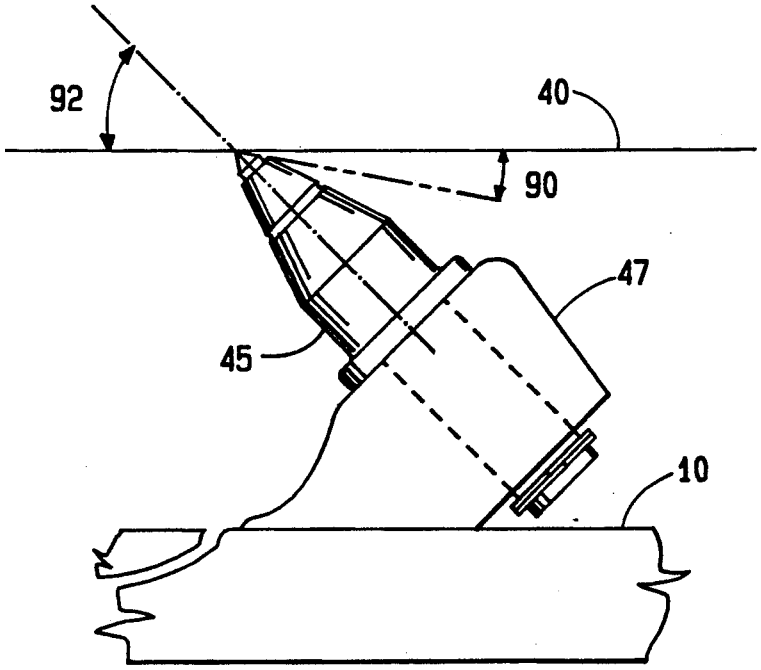

FIG. 9 shows the relationship between the tooth angle 92 and the cutting clearance angle 90, and it can be seen that the effective clearance angle 90 can be increased, within limits, by increasing the tooth angle 92.

It is clear that resistance to the travel of digging chain 10 will increase as the teeth 45 are forced more intimately into cutting surface 40 by the aforementioned straight line vibratory forces, and that this increased resistance will proportionately increase the angular deflection of the sprocket outer hub 58 relative to the sprocket inner hub 54. This increment should be no more than about 20% of the travel/vibration cycle of tooth 45 in order to avoid over running the tooth cutting clearance angle. This will occur when the instantaneous tooth penetration rate divided by the cutting speed exceeds the tangent of the cutting clearance angle 90.

This clearance consideration thereby establishes the radial thickness of resilient coupling 60. The mass of sprocket outer hub 58 is then elected, by varying the outside diameter thereof, to place the natural frequency of the resilient coupling 60 well out of the range of any exciting frequency.

Other alternate means of exciting directionally oriented vibration are available within the scope of the invention. The chain saw boom assembly 220 of FIG. 10 comprises a weight 100 which is caused to oscillate about its pivotal attachment 116 to digging chain support boom 101. The oscillating vibratory movement of weight 100 is driven by motor means 111, not shown, which rotates drive sprocket 112 and, by means of chain 114, driven sprocket 110. Driven sprocket 110 is mounted on eccentric shaft 108, rotating in bearings 115. Link 106 is mounted on the eccentric portion of eccentric shaft 108 by needle bearings 117 and connected to weight 100 by pin 116 so that the rotation of said eccentric causes oscillatory movement of weight 100 at a desired frequency. Vibratory reaction forces at the pivotal attachment 116 are minimized by locating the connection 116 of link 106 at the center of percussion 102 of weight 100. The path of oscillation of weight 100 is about an arc having a perpendicular bisector lying substantially parallel to the plane of cutting surface 40. The eccentric shaft 108 is located at the center of percussion 104 of chain boom assembly 220 so as to minimize the vibratory reaction forces at said resilient connections 36L and 36R.

Another alternate means of exciting directionally oriented vibration available within the scope of the invention is shown in FIG. 12 wherein a commercially available reciprocating piston vibrator 124, such as a Model VMSAC 1500 air piston vibrator, made by Cleveland Vibrator Company of Cleveland, Ohio is mounted to back wall 121 of digging chain support boom 120 in chain saw boom assembly 230. Vibrator 124 is supplied with pressurized air through supply hose 126. The location of vibrator 124 is at the center of percussion 122 of chain saw boom assembly 230, and the piston axis of reciprocation 128 is perpendicular to the plane of cutting surface 40.

FIG. 13 shows an alternate preferred embodiment of the invention installed on excavating machine 100', wherein rotary rock saw boom assembly 250 is substituted for chain saw boom assembly 200 of the chain saw excavating machine 100 of FIG. 1. The rock saw support boom 130, having upper end 128 and lower end 129, carries circular rock saw blade 132 which is mounted on rotating shaft 131. Rock saw blade 132 has peripheral cutting teeth 133 and is powered for rotation by hydraulic motor 137 and reducing gear box 135. Main frame isolation connectors 150L and 150R, similar to the corresponding connectors 50L–50R of FIG. 1, join support boom 130 to main frame 14' at pivotal connections 36L' and 36R'. Hydraulic cylinders 136L and 136R, with cylinder isolation connectors 148L and 148R, similar to the corresponding connectors 48L–48R of FIG. 1, connect main frame pivotal connections 138L and 138R to support boom pivotal connections 134L and 134R respectively. Actuation of cylinders 136L and 136R move boom assembly pivotally about axis 36L'–36R' so that cutting teeth 133 engage the ground along cutting surface 140 as shown. Rotation of rock saw blade 132 digs trench 143 as crawler tracks 32' advance on ground surface 142. Retraction of cylinders 136L and 136R raise cutting teeth 133 above ground surface 142 in a manner similar to that of FIG. 1. The center of percussion 164 of boom assembly 250 relative to boom pivotal axis 36L'–36R' lies in a plane 160 radial to said axis. Balanced eccentric weights 152 and 152' are mounted in housing 154 for counter-rotation on parallel axes 155 and 155' which are both parallel to and equidistant from radial plane 160. The rotation is synchronized, and the phase angles are timed so that opposed centrifugal forces cancel, producing straight line vibration along line-of-action 162, substantially perpendicular to the radial plane 160 and acting at center of percussion 164. Housing 154 is mounted on yoke member 156 for transmission of vibratory forces to support boom 130 and rock saw blade 132. Use of rock saw blade 132 rather than a chain saw differs mainly in the cutting surface 140 is arcuately curved instead of flat. Effective vibration however, and isolation of vibratory forces involve the same considerations with either digging means. The relationship of the straight line vibratory line-of-action 162 to center of percussion 164 and to boom pivotal axis 36L'-36R' is changed only by the physical requirements of mounting. The present invention isolates the vibration of support boom 130 from main frame 14' by applying straight line exciting vibratory forces at the center of percussion 164 so as to induce angular vibration of boom assembly 250 about its pivotal axis 36L-36R without adverse reaction forces. The vibratory line-of-action 162 is thus essentially perpendicular to radial plane 160 at the center of percussion 164.

In FIG. 14 is shown the combining of cutting torque reaction vector 165 and crowd force reaction vector 167 as the nominal vector sum of cutting forces 166. The vector sum 166 varies with the relative depths of hard formation 144 and soft overlay 145, but in any case is effectively enhanced by the angular vibration about pivotal axis 136'-36R'. Transmission of destructive vibration to the main frame 14' is avoided by acting at the center of percussion 164. The parallel orientation of main frame isolation connectors 150L and 150R relative to the vibratory line-of-action 162 provides cushioning deflection for secondary shock loads in that direction and stiffness to support the reaction force vector 168.

The graphic representations of the cylinder force vector 170 and reaction force vector 168 are derived from the assumed nominal value of cutting force 166. The radii 172 and 174 show how angular vibration about axis 36L-36R augments penetration forces working on cutting surface 140.

Thus, although the curved cutting surface 140 of rock saw 132 is not the convenient reference plane of a chain saw, the working relationship of vibration to cutting forces and isolation means is the same.

If isolation of a vibrating body from a spring connected, stable body is desired, conventional practice requires that the stable body be of significantly greater mass than the vibrating body. A mass ratio exceeding 10:1 is considered necessary for practical isolation, but neither chain saw 200 (FIG. 1) nor rock saw 250 (FIG. 13) permits such a ratio with a prime mover of acceptable size. The present invention avoids that limitation by causing straight line vibratory forces to act at the center of percussion of the digging means, exciting a purely angular mode of vibration that is not transmitted through its connection to the main frame. Any straight line vibration input, such as the oscillatory device of FIG. 10 or the reciprocating device of FIG. 12 may be used in a similar manner for either a rock saw or a chain saw.

It will be understood that the invention is not limited to the disclosed embodiments, but is capable of rearrangement, modification and substitution of parts and elements without departing from the spirit of the invention.

I claim:

1. A boom type continuous excavating machine comprising:

a main frame:

an undercarriage supporting said main frame for forward and reverse movement along the ground;

a support boom having upper and lower ends;

digging means in rotatable assembly with said support boom for engaging the ground, said digging means including peripheral cutting means for continuously cutting and excavating ground material;

drive means for powering continuous rotation of said digging means;

connecting means adjacent said boom upper end connecting said support boom to said main frame for pivotal movement from a first position in which said digging means engages the ground along a cutting surface to a second position in which said digging means is raised above the ground, the assembly of said support boom and said digging means having a center of percussion spaced from said connecting means;

actuating means connecting said main frame to said support boom at a position adjacent said upper end for pivoting said boom assembly between said first and second positions; and directionally oriented vibration exciting means having direction of vibration, substantially perpendicular to a radial line formed by said center of percussion and said pivotal connecting means, and substantially aligned with said center of percussion.

2. A boom type continuous excavating machine according to claim 1 wherein said directionally oriented vibration exciting means further comprises:

a plurality of balanced rotary eccentric weights rotating on substantially parallel axes lying in a plane perpendicular to said direction of vibration; and drive means mounted on said support boom for synchronously phased counter-rotation of said rotary eccentric weights.

3. A boom type continuous excavating machine according to claim 2 wherein said drive means further comprises:

individual motor means for independently driving the rotation of each said eccentric weight so that said rotating eccentric weights are allowed to seek synchronous speed and balancing phase angles.

4. A boom type continuous excavating machine according to claim 2 wherein said drive means further comprises:

motor means for driving the rotation of at least one said eccentric weight; and geared connecting means for driving all said eccentric weights at synchronous speed and balancing phase angles.

5. A boom type continuous excavating machine according to claim 1 wherein said directionally oriented vibration exciting means comprises:

a weight mounted for reciprocating movement in said direction of vibration; and drive means mounted on said support boom for reciprocating said weight.

6. A boom type continuous excavating machine according to claim 1 wherein said directionally oriented vibration exciting means comprises:

a weight mounted for oscillating movement along an arc having a perpendicular bisector lying in a plane perpendicular to said direction of vibration; and drive means mounted on said support boom for oscillating said weight.

7. A boom type continuous excavating machine according to claim 1 wherein said pivotal connecting means further comprises:

directionally resilient means oriented so as to be resistant to displacement perpendicular to said direction of vibration and relatively compliant to displacement parallel thereto.

8. A boom type continuous excavating machine according to claim 7 wherein said directionally resilient means further comprises:

an elongate inner member on each side of said boom lying axially parallel to said direction of vibration;

a tubular outer member encompassing the longitudinal surfaces of said inner member so as to allow clearance therebetween;

a resilient elastomeric intermediate member of uniform thickness bonding said outer member to said inner member along the cooperating longitudinal surfaces thereof; and connection means for attachment of said inner member and said outer member to said support boom and said main frame alternatively so that compliance is provided by the shearing deformation of said elastomer parallel to said direction of vibration and stiffness is provided by the resistance of said elastomer to compression perpendicular thereto.

9. A boom type continuous excavating machine comprising:

a main frame;

an undercarriage supporting said main frame for forward and reverse movement along the ground;

a support boom having upper and lower ends;

digging means in rotatable assembly with said support boom for engaging the ground, said digging means including peripheral cutting means for continuously cutting and excavating ground material;

drive means for powering continuous rotation of said digging means;

a pivotal connection to said main frame adjacent said support boom assembly upper end for rotating said boom assembly from a first position in which said digging means engages the ground along a cutting surface to a second position raising said digging means above the ground, the assembly of said support boom and said digging means having a center of percussion spaced from said pivotal connection and said connection further comprising directionally resilient means for permitting load induced displacement perpendicular to a radial line formed by said center of percussion and said connection and resisting such displacement parallel to said plane; and actuating means connecting said main frame to said support boom at a position adjacent said upper end for pivoting said boom assembly between said first and second positions.

10. A boom type continuous excavating machine according to claim 9 wherein said directionally resilient means further comprises:

an elongate inner member on each side of said support boom lying axially parallel to said direction of vibration;

a tubular outer member encompassing the longitudinal surfaces of said inner member so as to allow clearance therebetween;

a resilient elastomeric intermediate member of uniform thickness bonding said outer member to said inner member along the cooperating longitudinal surfaces thereof; and connection means for attachment of said inner member and said outer member to said support boom and said main frame alternatively so that compliance provided by the shearing deformation of said elastomer perpendicular to said radial plane and stiffness is provided by resistance of said elastomer to compression parallel thereto.

11. A boom type continuous excavating machine comprising:

a main frame;

an undercarriage supporting said main frame for forward and reverse movement along the ground;

a support boom having upper and lower ends;

digging means in rotatable assembly with said support boom for engaging the ground, said digging means including peripheral cutting means for continuously cutting and excavating ground material;

drive means for powering continuous rotation of said digging means;

a pivotal connection to said main frame adjacent said boom assembly upper end for rotating said boom assembly from a first position in which said digging means engages the ground along a cutting surface to a second position raised above the ground;

a hydraulic cylinder having first and second ends connected to said main frame and said support boom alternatively for rotating said boom assembly about said pivotal connection between said first and second positions;

an elongate inner member axially extending from said cylinder first end;

a tubular outer member axially encompassing the longitudinal surfaces of said inner member so as to allow clearance therebetween; and a resilient elastomeric intermediate member of substantially uniform thickness bonding said outer member to said inner member along the cooperating longitudinal surfaces thereof so as to cushion dynamic axial loading of said hydraulic cylinder.

12. A boom type continuous excavating machine comprising:

a main frame;

an undercarriage supporting said main frame for forward and reverse movement along the ground;

a support boom having upper and lower ends;

a circular rock saw in rotatable assembly with said support boom;

cutting teeth at the periphery of said rock saw;

drive means for powering continuous rotation of said rock saw;

connecting means adjacent said boom upper end connecting said support boom to said main frame for pivotal movement from a first position in which said rock saw engages the ground along a cutting surface to a second position in which said rock saw is raised above the ground, the assembly of said support boom and said rock saw having a center of percussion spaced from said connecting means;

hydraulic cylinder means connecting said main frame to said support boom at a position adjacent said upper end for pivoting said boom assembly about said connecting means between said first and second positions; and directionally oriented vibration exciting means having a direction of vibration, substantially perpendicular to a radial line formed by said center of percussion and said pivotal connecting means, and substantially aligned with said center of percussion.

13. A boom type continuous excavating machine according to claim 12 wherein said directionally oriented vibration exciting means further comprises:

a plurality of balanced rotary eccentric weights rotating on substantially parallel axes lying in a plane perpendicular to said direction of vibration; and drive means mounted on said support boom for synchronously phased counter-rotation of said rotary eccentric weights.

14. A boom type continuous excavating machine according to claim 13 wherein said drive means further comprises:

individual motor means for independently driving the rotation of each said eccentric weight so that said rotating eccentric weights are allowed to seek synchronous speed and balancing phase angles.

15. A boom type continuous excavating machine according to claim 13 wherein said drive means further comprises:

motor means for driving the rotation of at least one said eccentric weight; and geared connecting means for driving all said eccentric weights at synchronous speed and balancing phase angles.

16. A boom type continuous excavating machine according to claim 12 wherein said directionally oriented vibration exciting means comprises:

a weight mounted for reciprocating movement in said direction of vibration; and drive means mounted on said support boom for reciprocating said weight.

17. A boom type continuous excavating machine according to claim 12 wherein said directionally oriented vibration exciting means comprises:

a weight mounted for oscillating movement along an arc having a perpendicular bisector lying in a plane perpendicular to said direction of vibration; and drive means mounted on said support boom for oscillating said weight.

18. A boom type continuous excavating machine according to claim 12 wherein said pivotal connecting means further comprises:

directionally resilient means oriented so as to be resistant to displacement perpendicular to said direction of vibration and relatively compliant to displacement parallel thereto.

19. A boom type continuous excavating machine according to claim 18 wherein said directionally resilient means further comprises:

an elongate inner member on each side of said boom lying axially parallel to said direction of vibration;

a tubular outer member encompassing the longitudinal surfaces of said inner member so as to allow clearance therebetween;

a resilient elastomeric intermediate member of uniform thickness bonding said outer member to said inner member along the cooperating longitudinal surfaces thereof; and connection means for attachment of said inner member and said outer member to said support boom and said main frame alternatively so that compliance is provided by the shearing deformation of said elastomer parallel to said direction of vibration and stiffness is provided by the resistance of said elastomer to compression perpendicular thereto.

20. A boom type continuous excavating machine comprising:

a main frame;

an undercarriage supporting said main frame for forward and reverse movement along the ground;

a support boom having upper and lower ends;

a circular rock saw in rotatable assembly with said support boom;

cutting teeth at the periphery of said rock saw;

drive means for powering continuous rotation of said digging means;

a pivotal connection to said main frame adjacent said support boom upper end for rotating said boom assembly from a first position, in which said rock saw engages the ground along a cutting surface, to a second position raising said rock saw above the ground, the assembly of said support boom and said rock saw having a center of percussion spaced from said pivotal connection, said connection further comprising directionally resilient means for permitting load induced displacement perpendicular to a radial line formed by said center of percussion and said pivotal connection and resisting such displacement parallel thereto;

actuating means connecting said main frame to said support boom at a position adjacent said upper end for pivoting said boom assembly about said connecting means between said first and second positions; and directionally oriented vibration exciting means having a direction of vibration, substantially perpendicular to said radial line and substantially aligned with said center of percussion.

21. A boom type continuous excavating machine according to claim 20 wherein said directionally resilient means further comprises:

an elongate inner member on each side of said support boom lying axially parallel to said direction of vibration;

a tubular outer member encompassing the longitudinal surfaces of said inner member so as to allow clearance therebetween;

a resilient elastomeric intermediate member of uniform thickness bonding said outer member to said inner member along the cooperating longitudinal surfaces thereof; and connection means for attachment of said inner member and said outer member to said support boom and said main frame alternatively so that compliance is provided by the shearing deformation of said elastomer parallel to said direction of vibration and stiffness is provided by resistance of said elastomer to compression perpendicular thereto.

22. A boom type continuous excavating machine comprising:

a main frame;

an undercarriage supporting said main frame for forward and reverse movement along the ground;

a support boom having upper and lower ends;

a circular rock saw in rotatable assembly with said support boom for engaging the ground, said rock saw including peripheral cutting means for continuously cutting and excavating ground material;

drive means for powering continuous rotation of said rock saw;

a pivotal connection to said main frame adjacent said boom assembly upper end for rotating said boom assembly from a first position in which said rock saw engages the ground along a cutting surface to a second position raised above the ground;

a hydraulic cylinder having first and second ends connected to said main frame and said support boom alternatively for rotating said boom assembly about said pivotal connection between said first and second positions;

an elongate inner member axially extending from said first end;

a tubular outer member axially encompassing the longitudinal surfaces of said inner member so as to allow clearance therebetween; and a resilient elastomeric intermediate member of substantially uniform thickness bonding said outer member to said inner member along the cooperating longitudinal surfaces thereof so as to cushion dynamic axial loading of said hydraulic cylinder.

* * * * *